US007721680B2

(12) United States Patent
Radke

(10) Patent No.: US 7,721,680 B2
(45) Date of Patent: May 25, 2010

(54) LINK TYPE SEISMIC TIE FOR BOILERS

(75) Inventor: Edward F. Radke, Wadsworth, OH (US)

(73) Assignee: Babcock & Wilcox Power Generation Group, Inc., Baberton, OH (US)

( * ) Notice: Subject to any disclaimer, the term of this patent is extended or adjusted under 35 U.S.C. 154(b) by 307 days.

(21) Appl. No.: 11/743,722

(22) Filed: May 3, 2007

(65) Prior Publication Data

US 2008/0271686 A1 Nov. 6, 2008

(51) Int. Cl.
*F22B 37/24* (2006.01)

(52) U.S. Cl. ..... 122/510; 122/511; 52/167.1; 248/68.1

(58) Field of Classification Search ..... 122/510, 122/511, 512; 376/438, 462, 461; 248/68.1; 165/134.1; 52/79.1, 167.1
See application file for complete search history.

(56) References Cited

U.S. PATENT DOCUMENTS 4,064,668 A * 12/1977 Carter ..... 52/295
4,101,288 A * 7/1978 Smith et al. ..... 422/144
4,581,199 A * 4/1986 Bioret et al. ..... 376/285
5,207,184 A * 5/1993 Kreider ..... 122/510
5,282,442 A * 2/1994 Payne ..... 122/510
5,363,613 A * 11/1994 Sevier ..... 52/263

FOREIGN PATENT DOCUMENTS

JP 06002804 A * 1/1994

* cited by examiner

*Primary Examiner*—Gregory A Wilson
(74) *Attorney, Agent, or Firm*—Michael J. Seymour; Eric Marich

(57) ABSTRACT

A link-type seismic tie is provided between a steel structural support and a buckstay, and includes two horizontally arranged, parallel, and spaced apart link members, which are connected at their ends to large vertical pins. Each of the link members includes two horizontally arranged and parallel longitudinal outboard stringers and a horizontally arranged and parallel longitudinal center stringer centered between the two outboard stringers. Each link member further includes finger plates standing upright and spaced apart from each other relatively perpendicular to the longitudinal stringers. The finger plates are held between each of the outboard stringers and the longitudinal center stringer. A gusset plate connects the outboard stringers to a pin plate, which is connected to a large pin at the buckstay. The other end of the link members is connected to a large pin at the steel structural support via the ends of the outboard stringers.

16 Claims, 5 Drawing Sheets

FIG. 1 – PRIOR ART

FIG. 2 - Prior Art

LINK TYPE SEISMIC TIE FOR BOILERS

FIELD AND BACKGROUND OF INVENTION

The present invention relates generally to the field of steam generators and in particular to a new and useful link type seismic tie for a boiler system for absorbing and dissipating seismic force or energy to limit the displacement of the boiler system, including support steel frames and piping.

During an earthquake, seismic energy is dissipated by damping due to plastic behavior of the structural system. The structural system consists of the supporting structural steel, boiler ties, and the boiler itself. Using certain techniques, the structural steel may be designed to enhance damping by plastic behavior. However, it is not practical to configure the boiler for enhanced plastic behavior. This is because the boiler's overall configuration is governed by the pressure part design and arrangement.

There are a variety of seismic ties currently available for dissipating seismic energy or forces. A typical link-type seismic tie is shown in FIG. 1, wherein two link members 32, 33 are attached by pins to a buckstay beam 36 at one end and structural steel 37 at the other. Finger plates 38, as shown in FIG. 2, are typically located in the ends of the buckstay beam 36 to further dissipate seismic energy by plastic behavior.

Japanese Patent JP6002804 to Minoru et al. discloses a link-type seismic tie comprising two link members arranged separately in a horizontal direction and two vertical pin members connecting both ends of the upper and lower link members. One of the pin members is attached to a bracket for connection to a supporting iron frame and the other pin member is attached to a buckstay connected to a boiler main body.

Japanese Patent 9112805 also discloses a supporting structure for load reduction of a boiler during an earthquake. The supporting structure includes a pair of links arranged between and connected to a pair of binders wherein one of the binders is attached to a buckstay of a boiler and the other binder is attached to a support structure. Elastic-plastic elements are provided between the binders and parallel to the links. The elastic-plastic elements contain a rounded diamond-shaped opening. A sheer plate is secured between the binders but faces in a direction perpendicular to the direction that the elastic-plastic elements face. Relative displacement caused by an earthquake, causes the binder near the buckstay to deform the elastic-plastic elements and the sheer plate, generating a restriction force. The involvement of the sheer plate in generating the restriction force reduces the number of elastic-plastic elements required.

U.S. Pat. No. 4,940,025 to Ott et al. discloses a steam generator support arrangement for loading forces resulting from seismic accidents. The support arrangement is provided between a ring girder encircling the steam generator and a concrete housing, and includes a pair of V-shaped link arrangements hinged at an apex and a snubber arranged between the link arrangements and connected to the apexes of the link arrangements.

Japanese Patent 5141607 discloses an assembly for transmitting furnace internal pressure from a buckstay to a supporting steel frame, absorbing the thermal expansion of the furnace pressurization. The assembly includes a coupling member attached to the buckstay. The coupling member is arranged between two separated link members, which lie along the same plane as the coupling member. The coupling member is attached to both link members at one end via a pin. Steel frames are attached to the link members via pins at the opposite end of the link members.

Japanese Patent 9178109 discloses a conventional prior art supporting structure for load reduction of the boiler during an earthquake. The supporting structure includes a pair of links connected to a pair of perpendicular binders which are a link mechanism for holding two or more elastic-plastic elements between a buckstay and a support frame, which are deformed upon the occurrence of an earthquake.

U.S. Pat. No. 4,286,549 to Eisinger discloses that it may be desirable to use rigid ties with springs and dampers for securing a steam generator to the upstanding members of a frame. The dampers react to displacement of components to which they are attached, to absorb energy as well as to carry load transmitted between the steam generator and frame. Springs are used as deformable structures.

U.S. Pat. No. 3,393,665 to Juchtern discloses a seismic tie attached to adjacent portions of a tube bank and furnace wall to limit relative movement and prevent distortion and damage to the furnace wall as a result of lateral forces caused by seismic disturbances for example.

The straight-bar link-type tie of the prior art provides only a very limited ability to dissipate seismic energy. At best, it may buckle providing some damping by plastically bending. However, this means of energy absorption is relatively ineffective and not easily or accurately predicted or controlled by design calculations. Also, unacceptably large boiler displacements may be necessary before any significant seismic energy would be absorbed.

In addition, because a large all-welded boiler is a very stiff body, it is important that damping plasticity be supplied at any location where it is possible to do so. One of the few possible locations at which damping may be added is where the boiler connects with the structural steel. The boiler tie links provide this location opportunity.

There is a need in the art for greater or more effective dissipation of seismic energy in connection with boiler seismic ties.

SUMMARY OF INVENTION

It is an object of the present invention to provide a seismic tie that dissipates seismic energy in a boiler system more effectively than a straight-bar link-type tie and supplies more damping than a straight-bar link-type tie to restrain the relative displacement between boiler and its supporting structure.

It is yet another object of the present invention to supply damping in a more predictable manner than known straight-bar link-type ties.

It is a further object of the present invention to protect the boiler from overstresses. This would be especially so if the actual applied seismic force happens to be greater than the forecasted design force.

Finally, it is an object of the present invention to provide protection against boiler pressure past rupture and furnace rupture by supplying a connection that is more able than the pressure parts alone to absorb seismic force while deforming.

Accordingly, a new link-type seismic tie is provided between a steel structural support and a buckstay, and includes two horizontally arranged, parallel, and spaced apart link members, which are connected at their ends to large pins. Each of the link members includes two horizontally arranged and parallel longitudinal outboard stringers and a horizontally arranged and parallel longitudinal center stringer centered between the two outboard stringers. Each link member further includes finger plates standing upright and spaced apart from each other relatively perpendicular the longitudinal stringers. The finger plates are held between each of the outboard stringers and the longitudinal center stringer. A gusset plate connects the outboard stringers to a pin plate, which is connected to a large pin at the buckstay. The other end of the link members is connected to a large pin at the steel structural support via the ends of the outboard stringers.

The finger plates include a diamond-shaped opening with rounded corners which increases the damping contribution provided by each finger plate. The shape of the opening gives the finger plate a varying cross section. The large pin at the buckstay of the boiler and the large pin at steel structural support includes a tapered cross section which increases the damping contribution provided by each pin. The shape of the large pins gives a varying cross section thus making the pin a so-called constant stress beam-type member.

The link type seismic tie of the present invention is designed to supply substantially more damping than a straight-bar link-type tie. Also, the seismic tie of the present invention accomplishes this in a more predictable manner because the plasticity in the bending of the finger plates is more predictable than the buckling and subsequent bending plasticity of a straight bar. Once a straight bar permanently kinks, it may be so severely misaligned that it does not provide any further restraint or damping. In addition to the usual dangers, an earthquake could be especially hazardous to boiler personnel for two reasons: pressure parts could burst, and hot combustion gas could be released if there is a furnace rupture. Therefore, the seismic tie of the present invention protects the boiler from overstresses, especially when the actual applied seismic force is greater than the forecasted design force. With respect to load-path, the seismic tie of the present invention is in series with the boiler's pressure parts, and therefore is in a position to provide protection against boiler pressure part rupture and furnace rupture by supplying a connection that is more able than the pressure parts alone to absorb seismic force while deforming.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
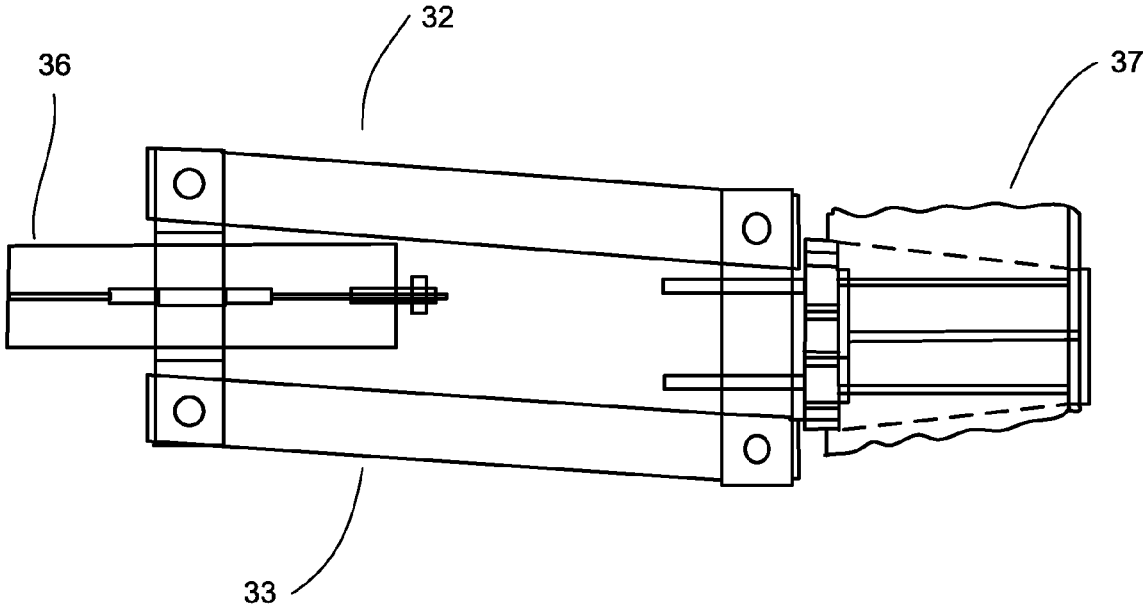
FIG. 1 is a schematic representation of a typical link-type seismic tie.
Figure 2:
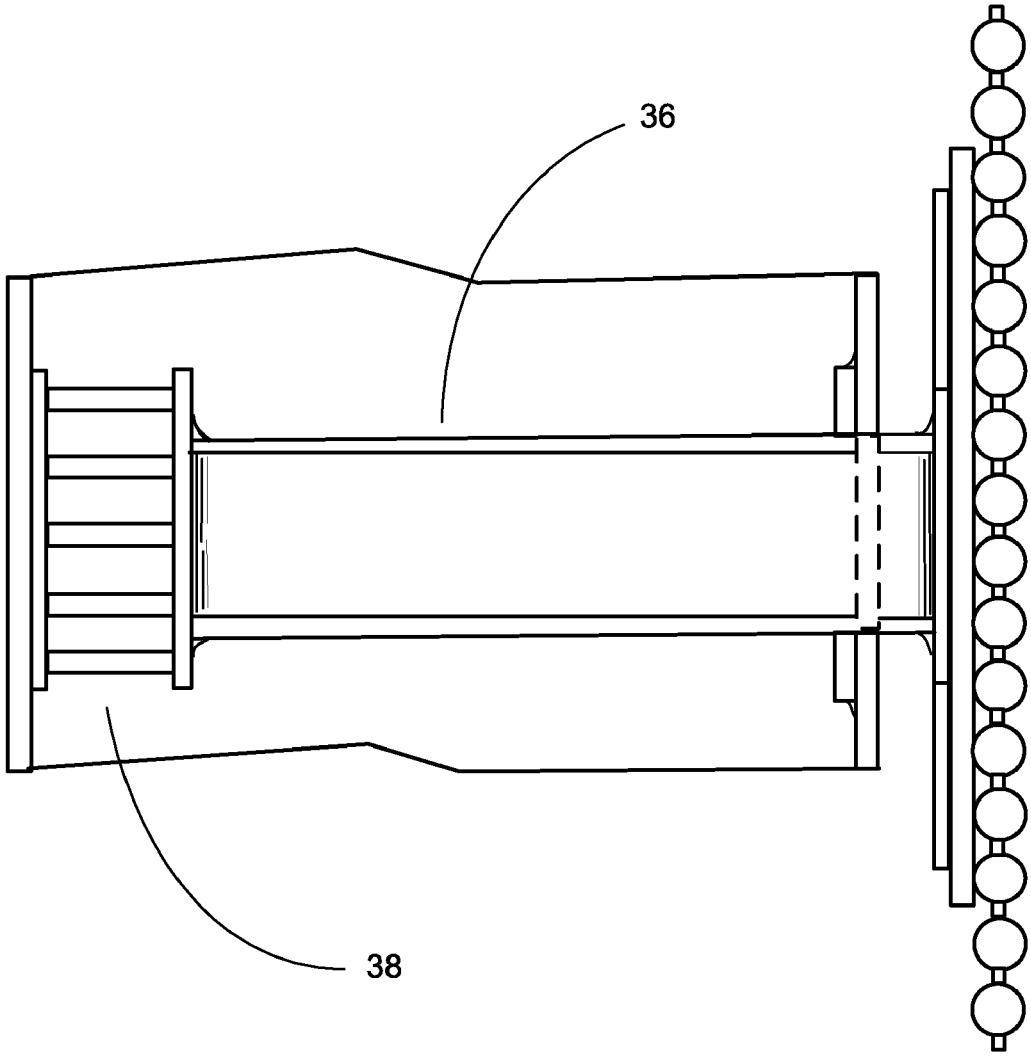
FIG. 2 is a cross section of a buckstay beam showing typical finger plates for the dissipation of seismic energy.
Figure 3:
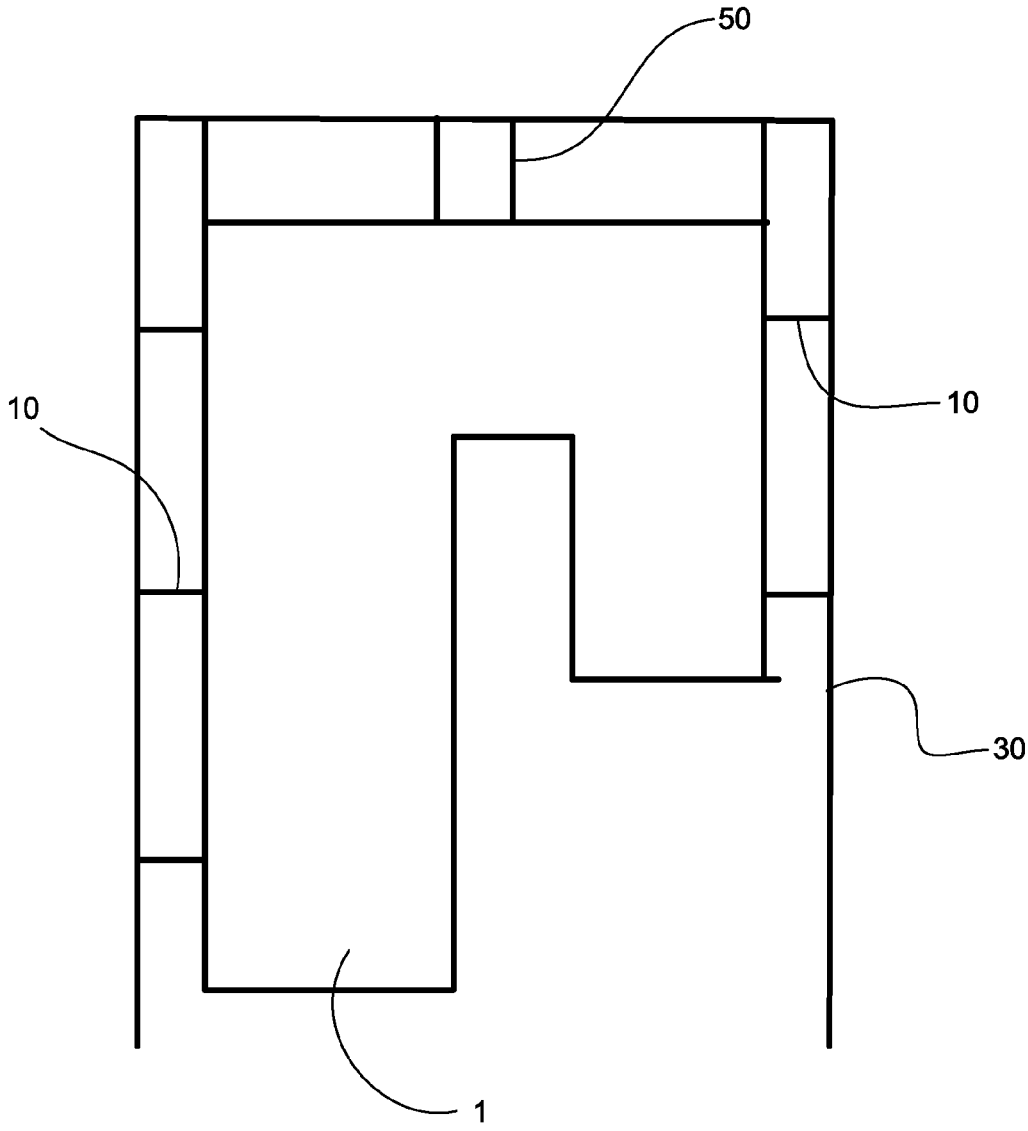
FIG. 3 is a schematic drawing of a boiler system containing the link-type seismic tie of the present invention.

Referring now to the drawings, in which like reference numerals are used to refer to the same or similar elements, FIG. 3 shows a schematic view of the link type seismic tie 10 arranged between a steel structural support 30 and a boiler 1. The boiler 1 is hung by rods 50 from the top of the steel support 30.

Figure 4:
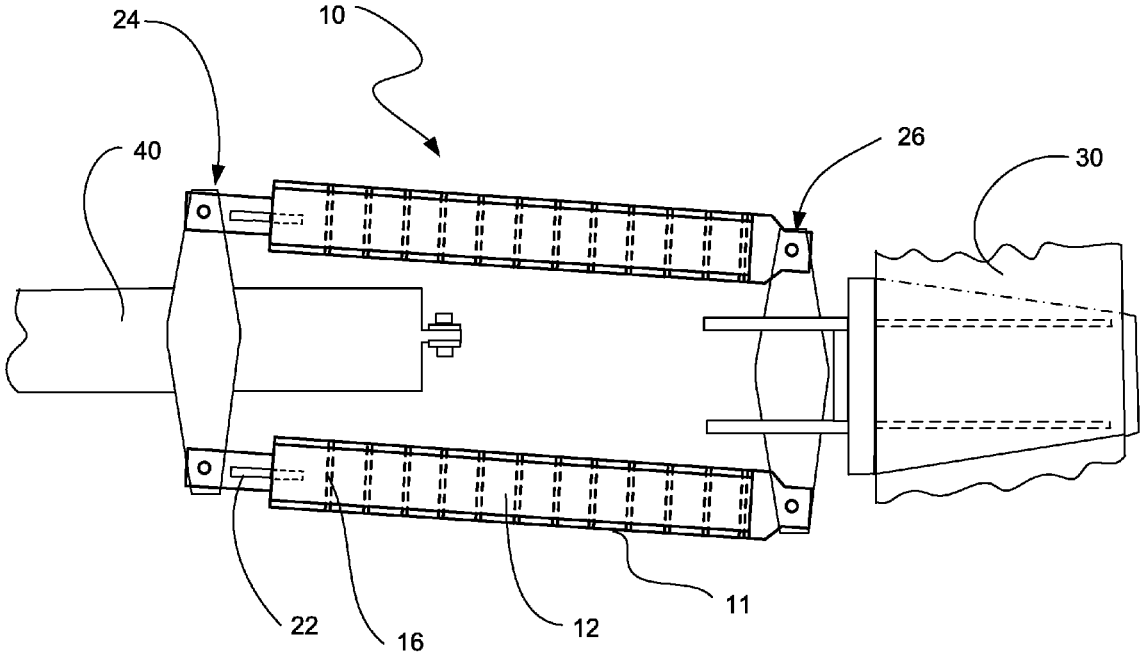
FIG. 4 is a side view of the seismic tie of the present invention connected between a steel support, and a buckstay of a boiler.

As shown in greater detail in FIG. 4, the seismic tie 10 is shown arranged between a steel structural support 30 and a buckstay 40 of a boiler 1. Boiler buckstays are described in more detail in U.S. Pat. Nos. 3,277,870, 4,059,075, 5,207,184, 5,557,901, which are incorporated by reference.

Figure 5:
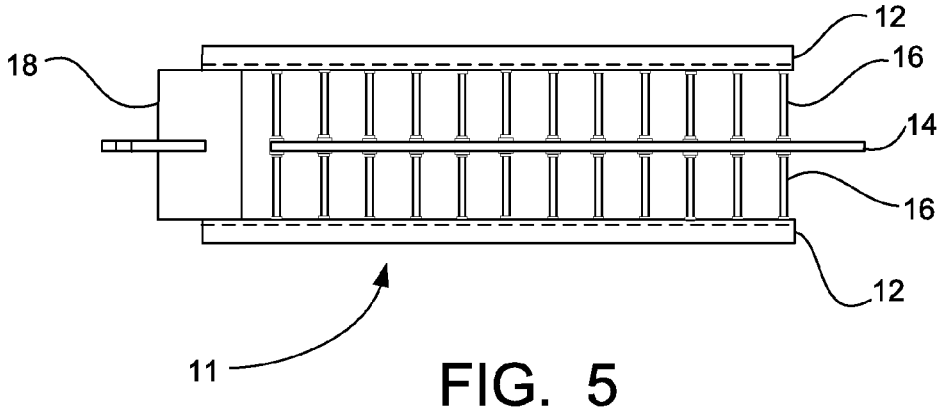
FIG. 5 is a top view of a link member with an attached gusset plate.
Figure 6:
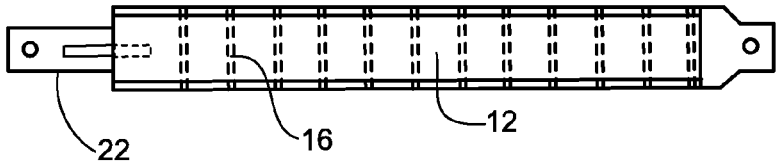
FIG. 6 is a side view of the link member with an attached gusset plate.

The seismic tie 10 comprises two horizontally arranged, parallel, and spaced apart link members 11, which are connected at their ends to large pins 24 and 26. As shown in greater detail in FIG. 5, each of the link members 11 include two horizontally arranged and parallel longitudinal outboard stringers 12 and a horizontally arranged and parallel longitudinal center stringer 14 centered between the two outboard stringers 12. Each link member 11 further includes finger plates 16 standing upright and spaced apart from each other relatively perpendicular to the longitudinal stringers 12 and 14. The finger plates 16 are held between each of the outboard stringers 12 and the longitudinal center stringer 14. The seismic tie 10 maintains a compression-stable, concentric, load path. In an actual design, the number of finger plates 16 required is a function of the design seismic load magnitude. Seismic forces are distributed to the finger plates 16 by the longitudinal outboard stringers 12 and center stringers 14.

The link-type seismic tie, and particularly the link members 11, is preferably made of steel parts. The outboard stringers 12 are preferably made from rolled steel channels. Taking advantage of the elasticity and plasticity of the steel, the seismic tie 10 is shaped to yield uniformly without localized plastic hinges under large restraint force and deformation.

Figure 7:
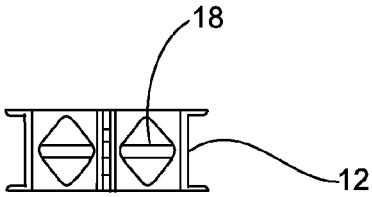
FIG. 7 is an end view of a link member.

As shown in FIGS. 4 and 7, a gusset plate 18 connects the outboard stringers 12 of each link member 11 to a pin plate 22, which is connected by smaller pins (not shown) to a large pin 24 at the buckstay 40. The other end of the link members 11 is connected to a large pin 26 at the steel structural support 30 via the ends of the outboard stringers 12. FIG. 4 also shows that the link members 11 are not at right angles with the large pins 24 and 26 when the boiler is not at operating temperatures. When the boiler is at operating temperatures, the link members 11 are generally at right angles with the large pins 24 and 26.

Figure 8:
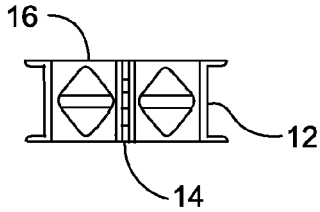
FIG. 8 is an opposite end view of a link.

As shown in FIGS. 7 and 8, the finger plates 16 include a diamond-shaped opening with rounded corners which is advantageous in that it involves more material volume in plastic behavior than would have occurred without the opening. This increases the damping contribution provided by each finger plate 16. The shape of the opening gives the finger plate 16 a varying cross section thus making the finger plate 16 a so-called constant stress beam-type member Turning back to FIG. 4, the large pin 24 at buckstay 40 and the large pin 26 at steel structural support 30 includes a tapered cross section which is advantageous in that it involves more material volume in plastic behavior than would have occurred without the tapered cross section. This increases the damping contribution provided by each pin. The shape of the large pins 24 and 26 gives a varying cross section thus making the pin a so-called constant stress beam-type member.

While a specific embodiment of the invention has been shown and described in detail to illustrate the application of the principles of the invention, it will be understood that the invention may be embodied otherwise without departing from such principles.

What is claimed is:

1. A boiler seismic tie comprising:

a pair of spaced apart link members, each link member arranged in a substantially horizontal direction and having at least two longitudinal stringers, and a plurality of substantially lateral finger plates arranged between the stringers; and a pair of vertical pins connected between the link members at opposite ends of the link members, wherein at least one end of said link members includes a gusset plate connected to a pin plate, the pin plate being connected on each of the link members to one of said vertical pins.

2. A boiler seismic tie according to claim 1, wherein the stringers for the link members are made from rolled steel channels.

3. A boiler seismic tie according to claim 1, wherein the finger plates comprise a diamond shape opening.

4. A boiler seismic tie according to claim 3, wherein corners of the diamond shape opening are rounded.

5. A boiler seismic tie according to claim 1, wherein the pins have a tapered cross-section.

6. A boiler seismic tie according to claim 1, wherein one of said pins is connected to a vertical steel support.

7. A boiler seismic tie according to claim 1, wherein one of the said pins is connected to a buckstay arrangement attached to a boiler.

8. A boiler seismic tie according to claim 1, wherein each link member contains at least one center longitudinal stringer, at least one longitudinal stringer on outer sides of said link member, and a plurality of substantially lateral finger plates arranged between the center stringer and the outer side stringers.

9. A boiler seismic tie comprising:

a pair of spaced apart link members, each link member arranged in a substantially horizontal direction and having a least one center longitudinal stringer, at least one longitudinal stringer on outer sides of said link member, and a plurality of substantially lateral finger plates arranged between the center stringer and the outer side stringers; and a pair of vertical pins connected between the link members at opposite ends of the link members via opposite ends of the vertical pins, one of said pins being connected to a structural support and another one of said pins being connected to a boiler.

10. A boiler tie link according to claim 9, wherein the pair of link members include a gusset plate connected to a pin plate on one side of the link member, the pin plate being connected on each of the link members to the vertical pin.

11. A boiler tie link according to claim 9, wherein the outer side stringers for the link members are made from rolled steel channels.

12. A boiler tie link according to claim 9, wherein the finger plates comprise a diamond shape opening.

13. A boiler tie link according to claim 12, wherein corners of the diamond shape opening are rounded.

14. A boiler tie link according to claim 9, wherein the pins have a tapered cross-section.

15. A boiler tie link according to claim 9, wherein one of said pins is connected to a vertical steel support.

16. A boiler tie link according to claim 9, wherein one of the said pins is connected to a buckstay arrangement attached to a boiler.

* * * * *